United States Patent [19]

Murashige

[11] Patent Number: 5,005,366

[45] Date of Patent: Apr. 9, 1991

[54] AIR CONDITIONING SYSTEM

[75] Inventor: Yoshinori Murashige, Shizuoka, Japan

[73] Assignee: Kabushiki Kaisha Toshiba, Kanagawa, Japan

[21] Appl. No.: 502,168

[22] Filed: Mar. 29, 1990

[30] Foreign Application Priority Data

Mar. 29, 1989 [JP] Japan ..... 1-74966

[51] Int. Cl.[5] ..... G01M 19/00

[52] U.S. Cl. ..... 62/126; 62/298

[58] Field of Search ..... 62/126, 125, 127, 77, 62/298, 160, 510, 161, 162, 163; 340/309.15, 309.2, 322, 328, 329, 384 R

[56] References Cited

U.S. PATENT DOCUMENTS 4,488,409 12/1984 Hara ..... 62/127
4,688,389 8/1987 Iida ..... 62/127
4,698,978 10/1987 Jones ..... 62/126

FOREIGN PATENT DOCUMENTS 0198634 11/1983 Japan ..... 62/126
63-15027 1/1988 Japan .

*Primary Examiner*—Harry B. Tanner
*Attorney, Agent, or Firm*—Philip M., Ltd. Shaw, Jr.

[57] ABSTRACT

An air conditioning system which includes a plurality of internal air conditioning units, a plurality of external refrigerating circuit units for executing refrigerating cycle operations, each external refrigerating circuit unit including a fluid path control valve whose activation is audible, and a plurality of corresponding relationship check switches respectively provided in the internal air conditioning units. When the corresponding relationship check switch of one of the internal air conditioning units is operated, the fluid path control valve of the corresponding external refrigerating circuit unit generates an audible sound, intermittently.

12 Claims, 5 Drawing Sheets

AIR CONDITIONING SYSTEM

BACKGROUND OF THE INVENTION

1. Field of the invention

The present invention relates, in general, to air conditioning systems. In particular, the invention relates to an air conditioning system which uses a plurality of split-type air conditioning apparatus each of which includes an internal air conditioning unit having a heat exchanger, a fan device and a control circuit and an external refrigerating circuit unit having a heat exchanger, a fluid path change value, a compressor, a fan device, etc. The internal air conditioning units of the air conditioning system are disposed inside the housing and the external refrigerating circuit units are disposed at a common place outside of the housing.

2. Description of the related art

In a building air conditioning system, a plurality of external refrigerating circuit units whose external shapes are similar to or the same as one another are disposed at a common place outside of the building. The plurality of external refrigerating circuit units are respectively connected to the corresponding internal air conditioning units, which are arranged inside the building, through refrigerant pipes.

In the above-described air conditioning system, it is necessary to check the corresponding relationship between the plurality of internal and external refrigerating circuit units when repairing or inspecting.

The Japanese laid-open patent No. 63-15027 discloses an air conditioning apparatus which has a "proving means" for detecting the above-described relationship and a control device for actuating the proving means. In this laid-open patent, a display lamp is provided, as the proving means, to the plurality of internal and external refrigerating circuit units, and a switch is provided, as the control device, in each remote controller which controls the operations of the corresponding internal and external refrigerating circuit units. Display lamps mounted on the corresponding internal and external refrigerating circuit units are operated when the switch (input means) of one of the remote controllers is operated. Thus, the proving operation can be carried out without actually operating the air conditioning apparatus. However, in the abovedescribed proving operation, an additional element, i.e., the display lamps, is needed to check the corresponding relationship between internal and external refrigerating circuit units. In addition to the manufacturing cost of these lamps, there is the additional problem of maintaining them to prevent failure which would prevent the proving operation. The Japanese laid-open patent also discloses another proving operation wherein internal and external fan devices are used as the proving means when inspecting. When the switch of one of the remote controllers is operated, the internal and external fan devices of the corresponding internal and external refrigerating circuit units are operated at a predetermined operation pattern. Thus, the proving operation can be executed without adding any elements. However, in this proving operation, undesirable air flow occurs in the corresponding room during the proving operation.

SUMMARY OF THE INVENTION

Accordingly, it is an object of the present invention to execute a corresponding relationship check operation for an air conditioning system wherein a plurality of internal air conditioning units are arranged inside of the building and the corresponding external refrigerating circuit units are arranged at a common place outside of the building without causing undesirable air flow.

To accomplish the above object, an air conditioning apparatus includes an external refrigerating circuit unit having a fluid path control valve for executing a refrigerating cycle operation, an internal air conditioning unit associated with the external refrigerating circuit unit for generating flow of conditioned air, and a corresponding relationship check device for outputting an operation command signal to intermittently energize the fluid path control valve thereby intermittently producing an audible sound from the fluid path control valve.

The air conditioning apparatus can include a timer for measuring the period of the intermittent operation of the fluid path control valve. The intermittent operation of the fluid path control valve is automatically terminated when the timer achieves a prescribed value.

BRIEF DESCRIPTION OF THE DRAWINGS

These and other objects and advantages of this invention will become apparent from the following detailed description of the presently preferred embodiments of invention, taken in conjunction with the accompanying drawings of which.

DETAILED DESCRIPTION OF THE PREFERRED EMBODIMENTS

Figure 1:
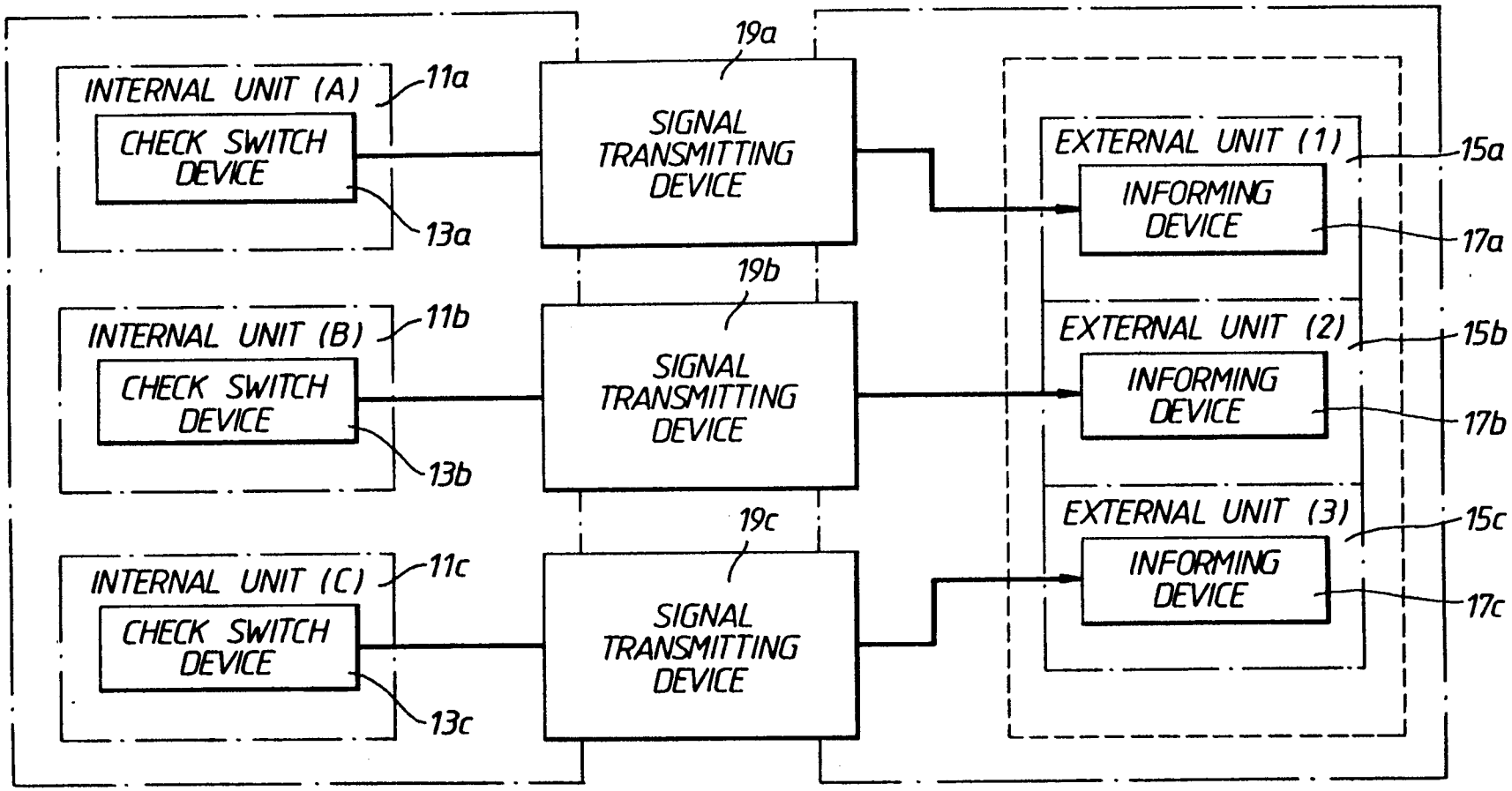
FIG. 1 is a block diagram illustrating the basic construction of the air conditioning system of the present invention.

Two preferred embodiments of the present invention will now be described with reference to the accompanying drawings. A basic construction of the present invention is shown in FIG. 1. A plurality of internal units 11*a*, 11*b* and 11*c* are arranged inside of the building. For example, the plurality of internal units 11*a*, 11*b* and 11*c* are installed in different rooms or different places, respectively. Each internal unit 11*a*, 11*b* and 11*c* includes conventional refrigerating elements (not shown), such as, e.g., an internal heat exchanger, an internal fan device, etc., to supply conditioned air. Each internal unit 11*a*, 11*b* and 11*c* also includes a check switch device 13*a*, 13*b* and 13*c*. Corresponding external units 15*a*, 15*b* and 15*c* are disposed at a common place outside of the building. Informing devices 17*a*, 17*b* and 17*c* are respectively provided in the external units 15*a*, 15*b* and 15*c*, each of which includes conventional refrigerating elements (not shown), e.g., a compressor, an external heat exchanger, an external fan device, a four-way valve, etc., to perform a refrigerating cycle operation. A plurality of signal transmitting devices 19*a*, 19*b* and 19*c* are respectively interposed between check switch devices 13*a*, 13*b* and 13*c* and informing devices 17*a*, 17*b* and 17*c* to transmit an operation command signal from each check switch 13*a*, 13*b* and 13*c* to the corresponding informing device 17*a*, 17*b* and 17*c*.

In the above-described construction, when an operator, e.g., a repairman, operates one of the check switch devices 13*a* of internal air conditioning unit 11*a* to output an operation command signal, the operation command signal is transmitted to informing device 17*a* of the corresponding external refrigerating circuit units 15*a* through signal transmitting device 19*a*. The operation command signal can be modulated to be a converted signal. When the operation signal or the converted signal is transmitted to informing device 17*a*, informing device 17*a* produces light or sound to inform the operator of the corresponding relationship. Thus, the operator can easily identify the corresponding relationship between the internal and external refrigerating circuit units 11*a* and 15*a* even though the plurality of external refrigerating circuit units 15*a*, 15*b* and 15*c* are arranged at a common place.

Figure 2:
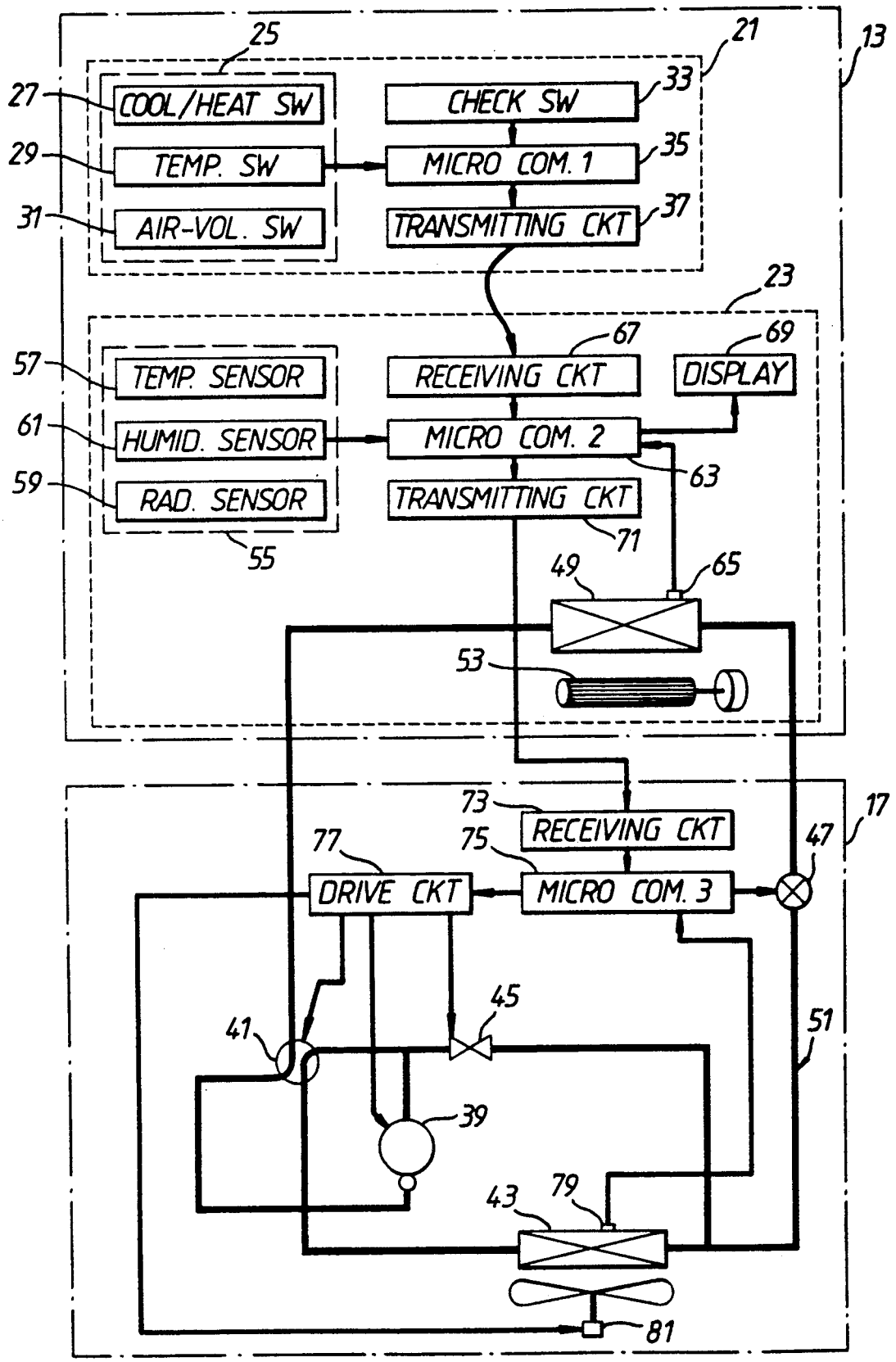
FIG. 2 is a block diagram illustrating an air conditioning apparatus of the air conditioning system embodiment of the present invention.
Figure 3:
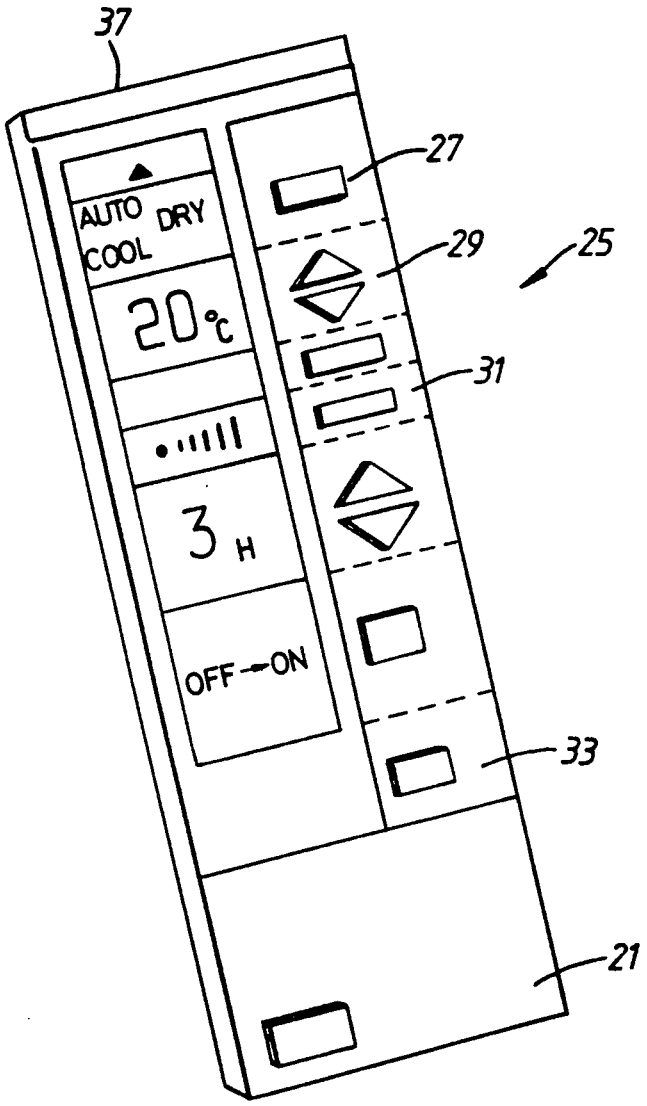
FIG. 3 is a perspective view illustrating a remote controller used in the air conditioning apparatus shown in FIG. 2.
Figure 4:
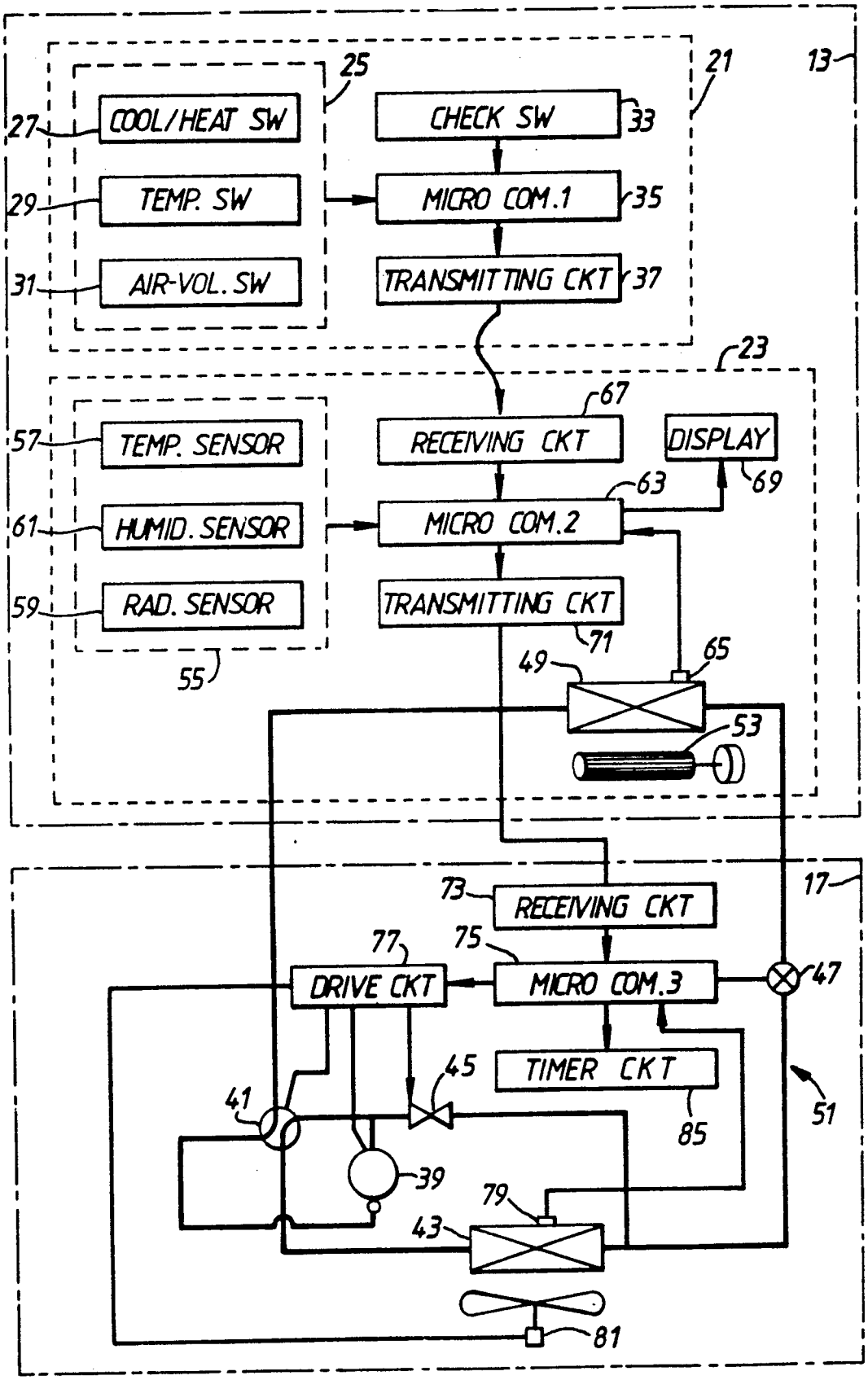
FIG. 4 is a block diagram of an air conditioning apparatus of a second embodiment.

One embodiment of the present invention will be described in more detail with reference to FIGS. 2, 3 and 4. As shown in FIG. 2, the internal air conditioning unit 13, including a remote controller 21 and an indoor device 23, is arranged inside of the building (not shown). An external refrigerating circuit unit 17 is disposed outside of the building. In this air conditioning system, a plurality of internal and external refrigerating circuit units are usually used and the plurality of external refrigerating circuit units are disposed at a common place outside of the building. In this embodiment the constructions of the plurality of internal and external refrigerating circuit units are similar to one another, and thus, the construction of only one of the plurality of internal and external refrigerating circuit units is described for the purpose of simplicity.

Remote controller 21 is provided with a function change switch section 25 including a heat/cool change switch 27 for outputting an operation signal, a temperature set switch 29 and an air volume change switch 31. A check switch 33 acting as a corresponding relationship check means, a first microcomputer 35 and a transmitting circuit 37 are also arranged in the remote controller 21, as shown in FIG. 3. Thus, when a signal is outputted from either the function change switch section 25 or the check switch 33, the signal is coded and modulated by the first microcomputer 35 to be a converted signal. The transmitting circuit 37 sends to the indoor device 23 to be controlled an operation signal generated by modulating infrared rays in accordance with the converted signal from the first microcomputer 35.

An air conditioning apparatus of this system is composed of a refrigerating circuit including a compressor 39, a four-way valve 41, an external heat exchanger 43 and an open/close valve 45 connected in parallel with the external heat exchanger 43. The refrigerating circuit also includes an expansion valve 47 and an internal heat exchanger 49. The refrigerating circuit elements are connected to one another by a pipe 51, as shown in FIG. 2.

The internal heat exchanger 49 of the refrigerating circuit is arranged in the indoor device 23, and an internal fan device 53 also is arranged opposite to the internal heat exchanger 49 to generate conditioned air flowing into the room. A sensor section 55 including a temperature sensor 57 for detecting the temperature of the room, a radiation sensor 59 for detecting the amount of heat radiation in the room and a humidity sensor 61 for detecting the humidity of the room is provided in the indoor device 23. A signal output from the sensor section 55 is input into a second microcomputer 63 arranged in the indoor device 23. A temperature sensor 65 is mounted on the internal heat exchanger 49 to output a signal indicating the temperature of the internal heat exchanger 49 to the second microcomputer 63.

A receiving circuit 67 is provided in the indoor unit 23 to demodulate the operation signal sent from the transmitting circuit 37. The receiving circuit 67 outputs the demodulated operation signal to the second microcomputer 63. When the second microcomputer 63 receives a signal from each sensor 57, 59, 61 and 65 or the modulated operation signal from the receiving circuit 67, the microcomputer 63 determines which object is to be controlled (indoor device 23 or external refrigerating circuit unit 17) on the basis of the received signal. When the indoor device 23 is determined as the object to be controlled, the microcomputer 63 controls a display section 69 or an internal fan device 53. Otherwise, the microcomputer 63 outputs a control signal based on the received signal to a serial signal transmitting circuit 71. AC serial signals are generated by serial signal transmitting circuit 71 in accordance with the control signal and are output to the external refrigerating circuit unit 17.

As shown in FIG. 2, the external refrigerating circuit unit 17 includes the external elements of the above-described refrigerating circuit, i.e., compressor 39, four-way valve 41, external heat exchanger 43, open/close valve 45, expansion valve 47, etc. The external refrigerating circuit unit 17 also includes a serial signal receiving circuit 73, a third microcomputer 75 and a drive circuit 77.

The serial signal receiving circuit 73 receives the AC serial signals sent from the serial signal transmitting circuit 71 and outputs the AC serial signals to the third microcomputer 75. When the third microcomputer 75 receives the AC serial signals from the serial signal receiving circuit 73, a control signal is fed to the drive circuit 77 to control the operation of the compressor 39 or the four-way valve 41. The open/close valve 45 is also controlled by the third microcomputer 75 through a drive circuit 77 to execute an open/close operation thereof when a detection signal fed from a temperature sensor 79 mounted on external heat exchanger 43 reaches a prescribed value. An external fan device 81 arranged opposite to external heat exchanger 43 is controlled by the third microcomputer 75 through drive circuit 77.

The operation of the above-described air conditioning apparatus will now be described. However, since the regular air conditioning operation of the apparatus is similar to that of a conventional air conditioning apparatus, only a check operation to determine the corresponding relationship between the internal air conditioning unit and the external refrigerating circuit unit thereof will be described. When an operation signal is input from the check switch 33 of the remote controller 21 to the first microcomputer 35, the operation signal is coded and modulated by the first microcomputer 35 to be a converted signal. The converted signal is fed to transmitting circuit 37. When the transmitting circuit 37 receives the converted signal, the transmitting circuit 37 generates an infrared ray signal obtained by modulating infrared rays in accordance with the converted signal and sends it to the receiving circuit 67 of the indoor device 23. The receiving circuit 67 demodulates the infrared ray signal to output the demodulated signal to the second microcomputer 63.

The second microcomputer 63 determines if the demodulated signal is the operation signal from check switch 21, and, if so, sends to the serial signal transmitting circuit 71 the control signal corresponding to the operation signal fed from check switch 21. The serial signal transmitting circuit 71 transmits the AC serial signals generated based on the control signal to the serial signal receiving circuit 73 of the external refrigerating circuit unit 17. The serial signal receiving circuit 73 transmits the AC serial signals to the third microcomputer 75.

The third microcomputer 75 identifies a control command from the AC serial signals. If a signal corresponding to the operation signal of the check switch 21 is included in the AC serial signals, the third microcomputer 75 determines if the control command is an operation command of the informing means and, if so, outputs a four-way valve operation signal to the drive circuit 77. In this embodiment, the four-way valve 41 acts as an informing means. Based on the four-way valve operation signal, the drive circuit 77 actuates the four-way valve 41, intermittently. Thus, the four-way valve 41 generates an audible metallic sound (value-changeover noise) at regular intervals. As a result, the operator can check the corresponding relationship between the internal and the external refrigerating circuit units in the air conditioning system simply by listening for the audible metallic sound and noting its location. When the operator reoperates the check switch 21 after identifying the corresponding relationship of the internal and the external refrigerating circuit units, an operation signal is transmitted from the first microcomputer 35 to the third microcomputer 75 by a signal transmitting operation similar to that of the above-described check operation. Thus, the drive circuit 77 stops the intermittent actuation of the four-way valve 41. During the above-described check operation, a regular air conditioning operation is not carried out.

With the above-described embodiment, since the four-way valve 41 generates an audible metallic sound intermittently when the check switch 33 operates, the operator can check the corresponding relationship between the internal and the external refrigerating circuit units without causing undesirable air flow during the check operation even though a plurality of external refrigerating circuit units are disposed at a common place.

In the above-described embodiment, the four-way valve 41 is used as an informing means, however, the open/close valve 45 can also be used as an informing means.

Figure 5:
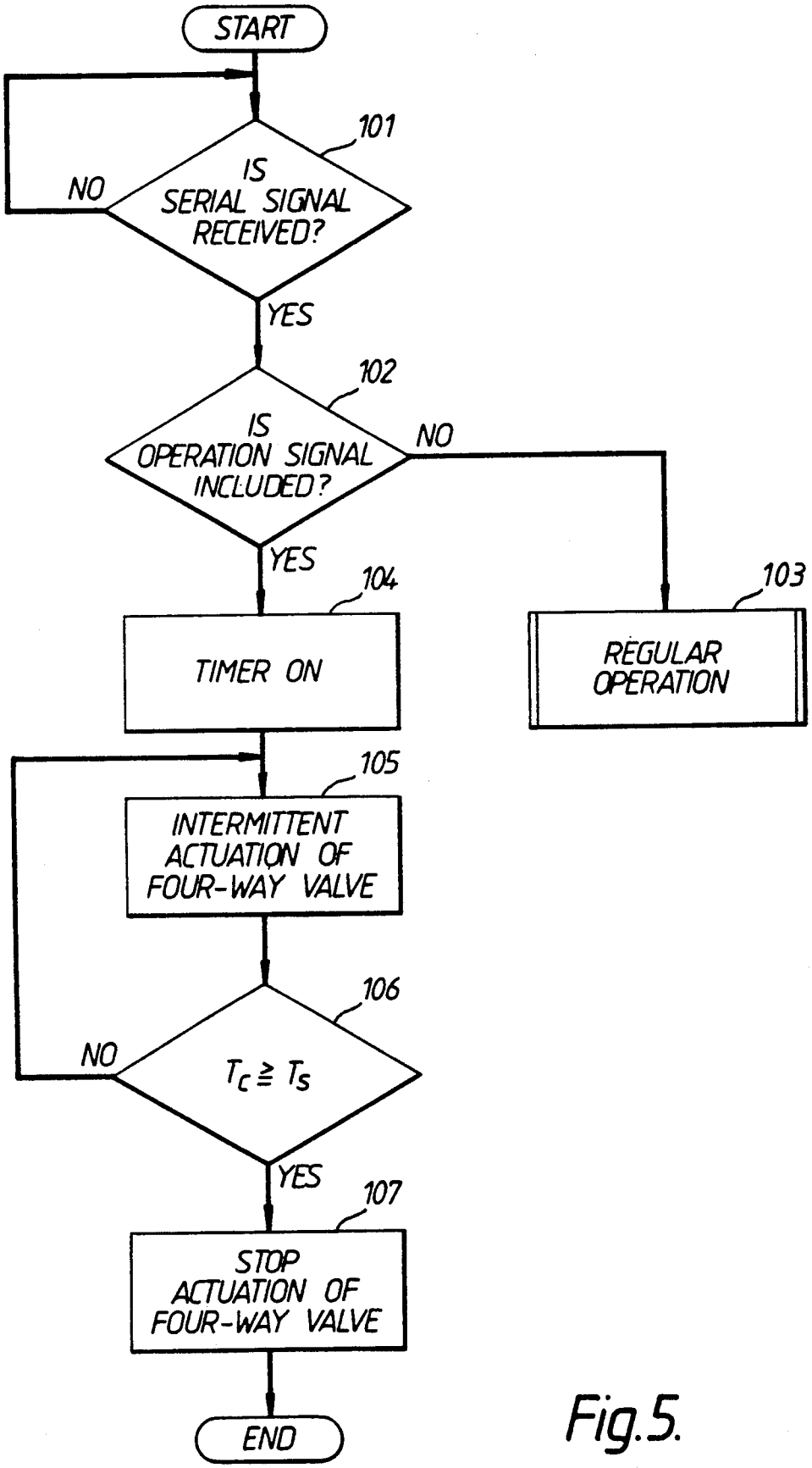
FIG. 5 is a flow chart of a corresponding relationship check operation of the air conditioning apparatus shown in FIG. 4.

A second embodiment of the present invention will be described with reference to FIGS. 4 and 5. However, in the drawings, the same numerals are applied to similar elements, and therefore, the detailed descriptions thereof are not repeated. In the second embodiment, a timer 85 is provided in the external refrigerating circuit unit 17 to automatically complete the check operation.

The operation of the second embodiment will be described with reference to the flow chart shown in FIG. 5. As stated above, an AC serial signal is transmitted to the external refrigerating circuit unit 17 when the check switch 33 is operated.

The third microcomputer 75 detects whether or not the AC serial signals are output from the serial signal receiving circuit 73. In step 101, if the AC serial signals are output from serial signal receiving circuit 73, the YES-path is taken. Otherwise, the NO-path is taken. When the YES-path is taken in step 101, the third microcomputer 75 detects whether or not the AC serial signals include a signal which commands the operation of the four-way valve 41. If the AC serial signals do not include the above-described signal, the NO-path is taken and a regular air conditioning operation is carried out in step 103. Otherwise, the YES-path is taken in step 102. The timer 85 begins the counting operation in step 104. In step 105, the four-way valve 41 is intermittently actuated by the third microcomputer 75 through the drive circuit 77. In the step 106, if a value Tc of the timer 85 does not achieve a prescribed value Ts, the NO-path is taken and the above-described step 105 is re-executed. If the YES-path is taken in step 106, the intermittent actuation of the four-way valve 41 is stopped in step 107.

As stated above, the four-way valve 41 intermittently operates for a prescribed period and stops automatically in the second embodiment.

With the above-described second embodiment, since the operation of the four-way valve 41 stops automatically without reoperating check switch 33, the operator can carry out the check operation to the internal and external refrigerating circuit units by himself or herself.

According to the present invention, since a fluid path control valve, e.g., the four-way valve 41 or the open/close valve 45, is used as an informing means, the corresponding relationship between the internal and the external refrigerating circuit units can easily be checked by listening for the metallic sound generated from the fluid path control valve when the valve is operated. Furthermore, no additional element is required to inform or indicate the corresponding relationship because the fluid path control valve is normally used in the refrigerating circuit. The use of the fluid path control valve can certainly check the corresponding relationship of internal and external refrigerating circuit units, as compared with the use of internal and external fan devices. This is because the fluid path control valve, e.g., the four-way valve, is seldom operated after the valve is set at one operation state, i.e., heating/cooling operation.

The present invention has been described with respect to specific embodiments. However, other embodiments based on the principle of the present invention should be obvious to those of ordinary skill in the art. Such embodiments are intended to be covered by the claims.

What is claimed:

1. An air conditioning apparatus comprising: external refrigerating circuit unit means for executing a refrigerating cycle operation;

fluid path control valve means, provided in the external refrigerating circuit unit means, for controlling the path of a fluid, the fluid path control valve means producing an audible sound when energized;

internal air conditioning unit means associated with the external refrigerating circuit unit means for generating a flow of conditioned air; and corresponding relationship check means for outputting an operation command signal to intermittently energize the fluid path control valve means thereby intermittently producing the audible sound from the fluid path control valve means.

2. An apparatus according to claim 1, wherein the fluid path control valve means includes a four-way valve.

3. An apparatus according to claim 1, wherein the fluid path control valve means includes an open/close valve.

4. An apparatus according to claim 1 further including a remote controller means for controlling the operations of the internal air conditioning unit means and the external refrigerating circuit unit means, and wherein the corresponding relationship check means is provided in the remote controller means.

5. An apparatus according to claim 1, wherein the corresponding relationship check means includes a switch provided in the internal air conditioning unit means to generate the operation command signal when the switch is operated.

6. An apparatus according to claim 1, wherein the external refrigerating circuit unit means includes timer means for measuring a period of the intermittent energization of the fluid path control valve means after the corresponding relationship check means is operated, the energization of the fluid path control valve means being automatically terminated when the timer means achieves a prescribed value.

7. An air conditioning system comprising:

a plurality of external refrigerating circuit unit means, installed at a common place, for executing a refrigerating cycle operation, each of the plurality of external refrigerating circuit unit means including a fluid path control valve which produces an audible sound when energized;

a plurality of internal air conditioning unit means associated with the corresponding external refrigerating circuit unit means for generating flow of conditioned air; and a plurality of corresponding relationship check means, each corresponding to one of the plurality of internal air conditioning unit means for outputting an operation command signal to the corresponding internal air conditioning unit means to intermittently energize the fluid path control valve of the corresponding external refrigerating circuit unit means thereby intermittently producing the audible sound from the fluid path control valve of the corresponding external refrigerating circuit unit means when the corresponding relationship check means of one of the plurality of internal air conditioning unit means is operated.

8. An apparatus according to claim 7, wherein the fluid path control valve includes a four-way valve.

9. An apparatus according to claim 7, wherein the fluid path control valve includes an open/close valve.

10. An apparatus according to claim 7 further including a plurality of remote controller means, each corresponding to one of the plurality of internal air conditioning unit means for controlling the operations of the corresponding internal air conditioning unit means and the external refrigerating circuit unit means and with the corresponding relationship check means being separately provided in the plurality of the remote controller means.

11. An apparatus according to claim 7, wherein each of the plurality of corresponding relationship check means includes a switch provided in the corresponding internal air conditioning unit means to generate the operation command signal when the switch is operated.

12. An apparatus according to claim. 7, wherein the plurality of external refrigerating circuit unit means each include timer means for measuring a period of the intermittent energization of the fluid path control valve of one of the plurality of external refrigerating circuit unit means after the corresponding relationship check means of the corresponding internal air conditioning unit means is operated, the energization of the fluid path control valve being automatically terminated when the timer means achieve a prescribed value.

* * * * *